US009240178B1

(12) United States Patent
Nadolski et al.

(10) Patent No.: US 9,240,178 B1
(45) Date of Patent: Jan. 19, 2016

(54) TEXT-TO-SPEECH PROCESSING USING PRE-STORED RESULTS

(71) Applicant: Amazon Technologies, Inc., Reno, NV (US)

(72) Inventors: Adam Franciszek Nadolski, Gdansk (PL); Michal Krzysztof Kiedrowicz, Gdansk (PL)

(73) Assignee: AMAZON TECHNOLOGIES, INC., Reno, NV (US)

( * ) Notice: Subject to any disclaimer, the term of this patent is extended or adjusted under 35 U.S.C. 154(b) by 28 days.

(21) Appl. No.: 14/315,807

(22) Filed: Jun. 26, 2014

(51) Int. Cl.
*G10L 13/02* (2013.01)

(52) U.S. Cl.
CPC ..... *G10L 13/02* (2013.01)

(58) Field of Classification Search
None
See application file for complete search history.

(56) References Cited

U.S. PATENT DOCUMENTS

2003/0187647 A1* 10/2003 Conkie ..... G10L 13/06 704/258
2005/0267758 A1* 12/2005 Shi ..... G10L 21/04 704/260
2009/0299746 A1* 12/2009 Meng ..... G10L 13/04 704/260
2010/0047260 A1* 2/2010 Leder ..... A61K 39/0011 424/184.1
2013/0030810 A1* 1/2013 Kopparapu ..... G06F 17/30873 704/260

* cited by examiner

*Primary Examiner* — Qian Yang
(74) *Attorney, Agent, or Firm* — Seyfarth Shaw LLP; Ilan N. Barzilay

(57) ABSTRACT

A text-to-speech (TTS) system is configured with multiple voice corpuses used to synthesize speech. An incoming TTS request may be processed by a first, smaller, voice corpus to quickly return results to the user. The text of the request may be stored by the TTS system and then processed in the background using a second, larger, voice corpus. The second corpus takes longer to process but returns higher quality results. Future incoming TTS requests may be compared against the text of the first TTS request. If the text, or portions thereof match, the system may return stored results from the processing by the second corpus, thus returning high quality speech results in a shorter time.

20 Claims, 7 Drawing Sheets

TEXT-TO-SPEECH PROCESSING USING PRE-STORED RESULTS

BACKGROUND

Human-computer interactions have progressed to the point where computing devices can render spoken language output to users based on textual sources available to the devices. In such text-to-speech (TTS) systems, a device converts text into an acoustic waveform that is recognizable as speech corresponding to the input text. TTS systems may provide spoken output to users in a number of applications, enabling a user to receive information from a device without necessarily having to rely on tradition visual output devices, such as a monitor or screen. A TTS process may be referred to as speech synthesis or speech generation.

Speech synthesis may be used by computers, hand-held devices, telephone computer systems, kiosks, automobiles, and a wide variety of other devices to improve human-computer interactions.

BRIEF DESCRIPTION OF DRAWINGS

For a more complete understanding of the present disclosure, reference is now made to the following description taken in conjunction with the accompanying drawings.

DETAILED DESCRIPTION

Figure 1:
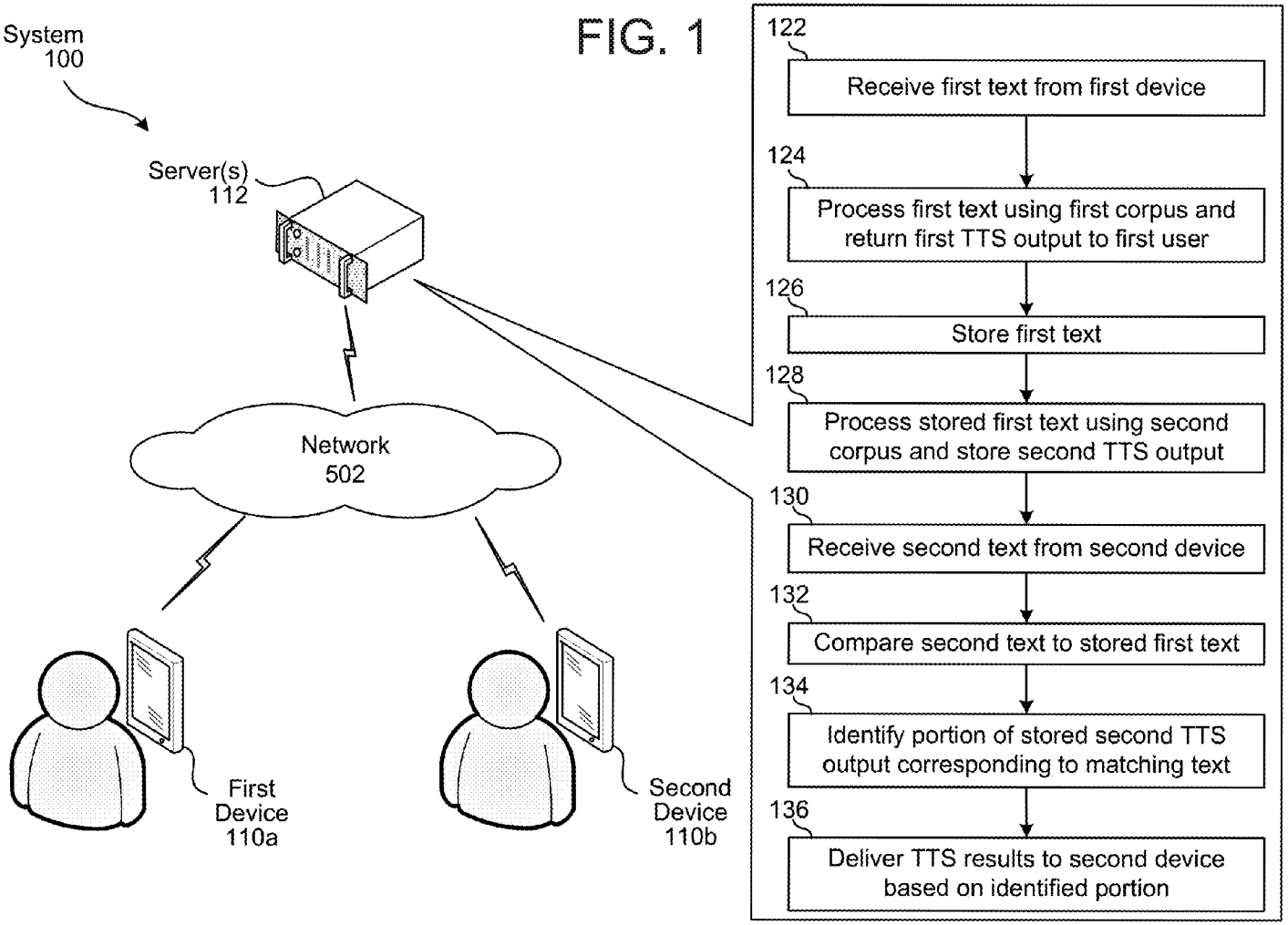
FIG. 1 illustrates a TTS system according to one aspect of the present disclosure.

Text-to-speech (TTS) processing may be a computationally intensive process, particularly when converting text into high quality speech. Natural sounding speech may be synthesized by matching incoming text to sound units stored in a database, sometimes called a voice corpus. The process of synthesizing speech using sound units is called unit selection, and is described further below. The voice corpus may include many hours of recorded speech (in the form of audio waveforms, feature vectors, or other formats), which may occupy a significant amount of storage. The recorded speech is typically divided into small segments called unit samples or units. The unit samples may be classified in a variety of ways including by phonetic unit (phoneme, diphone, word, etc.), linguistic prosodic label, acoustic feature sequence, speaker identity, etc. Each unit includes an audio waveform corresponding with a phonetic unit, such as a short .wav file of the specific sound, along with a description of the various acoustic features associated with the .wav file (such as its pitch, energy, etc.), as well as other information, such as where the phonetic unit appears in a word, sentence, or phrase, the neighboring phonetic units, etc. The voice corpus may include multiple examples of phonetic units to provide the TTS system with many different options for concatenating units into speech. Generally the larger the voice corpus the better quality speech that may be synthesized by virtue of the greater number of unit samples that may be selected from to form the precise desired speech output.

One problem with performing TTS processing with a large voice corpus is the large amount of computing resources (processor power, time, etc.) it takes to process a TTS request using large corpus. Thus, if a user submits a TTS request and expects quick results, using a large voice corpus to process the request may result in latency in completing the TTS processing and thus in undesirable user-noticeable delays. To avoid these delays, it is sometimes preferable to complete TTS processing quickly using a smaller voice corpus than a larger voice corpus. One drawback to this approach, however, is that the synthesized speech may not be as high quality as desired.

Offered is a potential solution to the typical speed versus quality tradeoff. A TTS system may be configured to store incoming TTS requests and provide quick TTS outputs for those requests using a small voice corpus capable of delivering quick results. The text of those TTS requests, however, may be stored by the TTS system, for example in a cache. At some point (for example, when computing resources are available to handle lower-priority tasks) the TTS system may once again perform TTS processing on the text of those TTS requests, only this time using a larger voice corpus capable of producing higher quality TTS output. As this second round of TTS processing using the larger voice corpus generally takes places in the background, quick turnaround time of results is not as important. The results of this second round of TTS processing may include audio including synthesized speech, or may include references to particular units of a unit database that may be used to synthesize speech. The higher quality TTS output may then also be stored in the TTS system and linked to the text that goes with the TTS output. When new TTS requests come in to the TTS system, the TTS system may compare the text of those new requests with the text of stored requests to identify matching text. When matching text is found, the TTS system may then identify the higher quality TTS output that has already been prepared that corresponds to the matching text. The TTS system may then create an output for the new request based on the already prepared higher quality TTS output (such as by outputting speech that has already been synthesized, or synthesizing speech based on units that have already been identified). This process of matching text and selecting already prepared output is faster than synthesizing text from scratch using a voice corpus. Thus, the TTS system is capable of outputting higher quality speech (for incoming TTS requests that match already stored text) without the typical processing delays.

FIG. 1 illustrates a TTS system for implementing the above solution. As shown a TTS system 100 may include one or more servers 112 connected to a network 502. Also connected to the network may be multiple user devices 110*a* and 110*b*. The server 112 may receive (122) a first TTS request from the first device 110*a*. The first TTS request may include first text. The server 112 may then process (124) the first text using a first voice corpus and return the output of that processing, referred to here as first TTS output, to the first device 110*a*. The first output may include synthesized speech corresponding to the first text. The server 112 may also store the first text (126). At some later point in time, the server 112 may process (128) the stored first text using a second voice corpus to obtain second TTS output. The second corpus may be larger than the first voice corpus and capable of being processed to obtain higher quality TTS results, although taking a longer time. The second TTS output may include audio including synthesized speech, may include references, such as index references, to units in a unit database, or may be in some other form. The second TTS output may result in higher quality speech than the first TTS output.

At some further point in time, the server 112 may receive (130) a second TTS request. For purposes of illustration, this second TTS request is shown as coming from second device 110*b*, though it can come from the first device 110*a*, or some other device. The second TTS request includes second text. The server 112 compares (132) the second text to the stored first text to see if there is any matching text between the two. If there is, the server 112 may identify (134) the portions of the stored second TTS output that correspond to the matching text. Those portions may correspond to the entire stored second TTS output (for example, if the first text is the same as the second text or if the first text is included in the second text), or may correspond to part of the stored second TTS output (for example if only a part of the first text is included in the second text). The server 112 may then deliver (136) TTS results to the second device 110*b* based on the identified portion of the stored second TTS output. This may include synthesizing speech using the identified portion of stored second TTS output.

Incoming TTS requests may include text for TTS processing and/or may include representations of the text. For example, a TTS request may include normalized text, phonetic units (such as phonemes, diphones, etc.), or other representations of text. These textual representations may be processed similarly to actual received text, and may be compared against each other (or against other forms of represented text) to identify potentially matching underlying text (or representation thereof) between TTS requests for purposes of outputting results for a new request based on stored results from an earlier request. Thus while the descriptions here may use text as an example for matching, representations of text may also be used.

Figure 2:
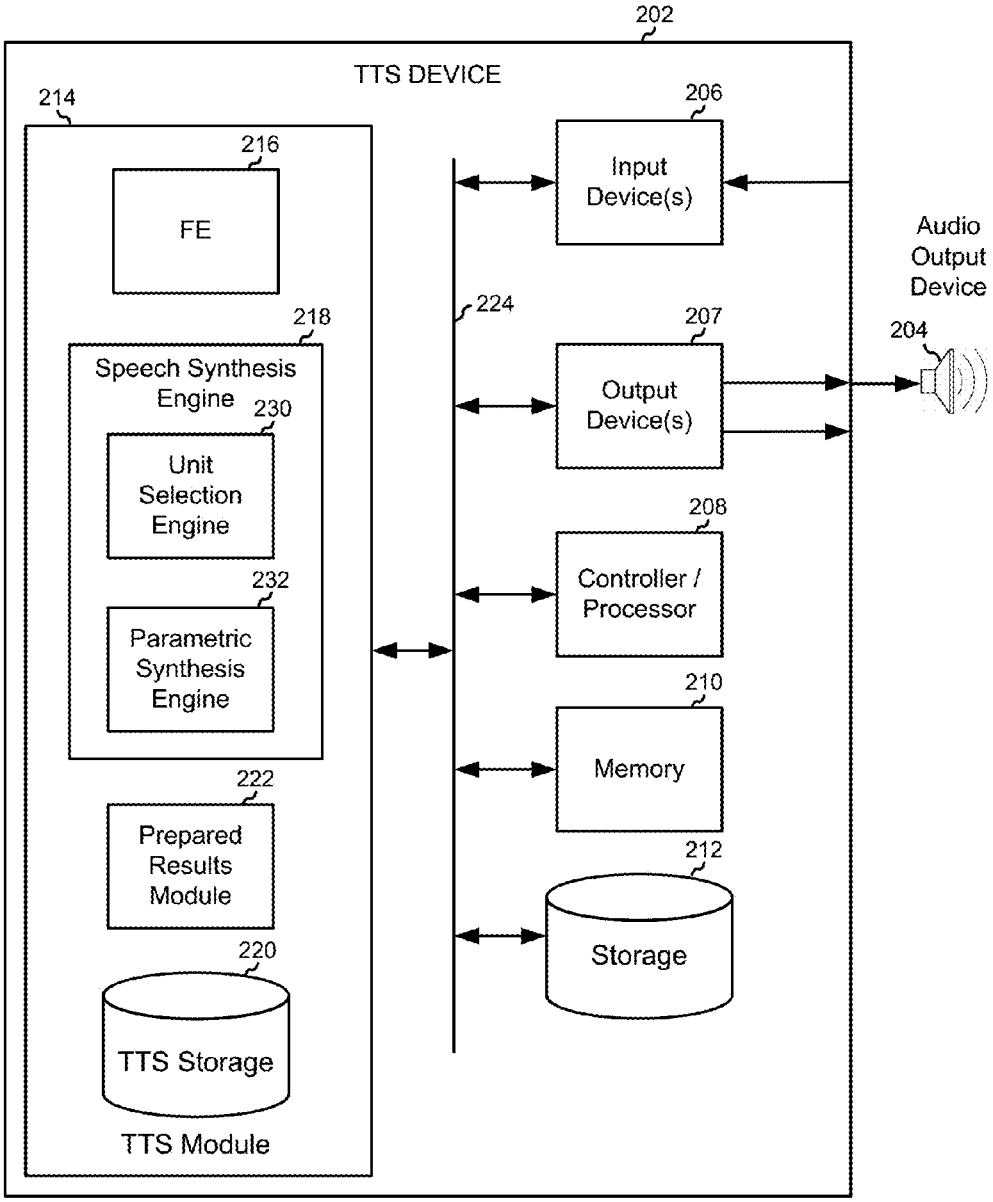
FIG. 2 is a block diagram conceptually illustrating a device for text-to-speech processing according to one aspect of the present disclosure.

Although illustrated above as performed by the server 112, the process of FIG. 1 may also be performed by a mobile TTS, or some other non-server TTS device. FIG. 2 shows a text-to-speech (TTS) device 202 for performing speech synthesis according to the present disclosure. Aspects of the present disclosure include computer-readable and computer-executable instructions that may reside on the TTS device 202. FIG. 2 illustrates a number of components that may be included in the TTS device 202, however other non-illustrated components may also be included. Also, some of the illustrated components may not be present in every device capable of employing aspects of the present disclosure. Further, some components that are illustrated in the TTS device 202 as a single component may also appear multiple times in a single device. For example, the TTS device 202 may include multiple input devices 206, output devices 207 or multiple controllers/processors 208.

Multiple TTS devices may be employed in a single speech synthesis system. In such a multi-device system, the TTS devices may include different components for performing different aspects of the speech synthesis process. The multiple devices may include overlapping components. The TTS device as illustrated in FIG. 2 is exemplary, and may be a stand-alone device or may be included, in whole or in part, as a component of a larger device or system, for example as server 112.

The teachings of the present disclosure may be applied within a number of different devices and computer systems, including, for example, general-purpose computing systems, server-client computing systems, mainframe computing systems, telephone computing systems, laptop computers, cellular phones, personal digital assistants (PDAs), tablet computers, other mobile devices, etc. The TTS device 202 may also be a component of other devices or systems that may provide speech recognition functionality such as automated teller machines (ATMs), kiosks, global position systems (GPS), home appliances (such as refrigerators, ovens, etc.), vehicles (such as cars, buses, motorcycles, etc.), and/or ebook readers, for example.

As illustrated in FIG. 2, the TTS device 202 may include an audio output device 204 for outputting speech processed by the TTS device 202 or by another device. The audio output device 204 may include a speaker, headphone, or other suitable component for emitting sound. The audio output device 204 may be integrated into the TTS device 202 or may be separate from the TTS device 202. The TTS device 202 may also include an address/data bus 224 for conveying data among components of the TTS device 202. Each component within the TTS device 202 may also be directly connected to other components in addition to (or instead of) being connected to other components across the bus 224.

The TTS device 202 may include a controller/processor 208 that may be a central processing unit (CPU) for processing data and computer-readable instructions and a memory 210 for storing data and instructions. The memory 210 may include volatile random access memory (RAM), non-volatile read only memory (ROM), and/or other types of memory. The TTS device 202 may also include a data storage component 212, for storing data and instructions. The data storage component 212 may include one or more storage types such as magnetic storage, optical storage, solid-state storage, etc. The TTS device 202 may also be connected to removable or external memory and/or storage (such as a removable memory card, memory key drive, networked storage, etc.) through the input device 206 or output device 207. Computer instructions for processing by the controller/processor 208 for operating the TTS device 202 and its various components may be executed by the controller/processor 208 and stored in the memory 210, storage 212, external device, or in memory/storage included in the TTS module 214 discussed below. Alternatively, some or all of the executable instructions may be embedded in hardware or firmware in addition to or instead of software. The teachings of this disclosure may be implemented in various combinations of software, firmware, and/or hardware, for example.

The TTS device 202 includes input device(s) 206 and output device(s) 207. A variety of input/output device(s) may be included in the device. Example input devices include an audio output device 204, such as a microphone, a touch input device, keyboard, mouse, stylus or other input device. Example output devices include a visual display, tactile display, audio speakers (pictured as a separate component), headphones, printer or other output device. The input device(s) 206 and/or output device(s) 207 may also include an interface for an external peripheral device connection such as universal serial bus (USB), FireWire, Thunderbolt or other connection protocol. The input device(s) 206 and/or output device(s) 207 may also include a network connection such as an Ethernet port, modem, etc. The input device(s) 206 and/or output device(s) 207 may also include a wireless communication device, such as radio frequency (RF), infrared, Bluetooth, wireless local area network (WLAN) (such as WiFi), or wireless network radio, such as a radio capable of communication with a wireless communication network such as a Long Term Evolution (LTE) network, WiMAX network, 3G network, etc. Through the input device(s) 206 and/or output device(s) 207 the TTS device 202 may connect to a network, such as the Internet or private network, which may include a distributed computing environment.

The device may also include an TTS module 214 for processing textual data into audio waveforms including speech. The TTS module 214 may be connected to the bus 224, input device(s) 206, output device(s) 207, audio output device 204, controller/processor 208 and/or other component of the TTS device 202. The textual data may originate from an internal component of the TTS device 202 or may be received by the TTS device 202 from an input device such as a keyboard or may be sent to the TTS device 202 over a network connection. The text may be in the form of sentences including text, numbers, and/or punctuation for conversion by the TTS module 214 into speech. The input text may also include special annotations for processing by the TTS module 214 to indicate how particular text is to be pronounced when spoken aloud. Textual data may be processed in real time or may be saved and processed at a later time.

The TTS module 214 includes a TTS front end (FE) 216, a speech synthesis engine 218, and TTS storage 220. The FE 216 transforms input text data into a symbolic linguistic representation for processing by the speech synthesis engine 218. The speech synthesis engine 218 compares the annotated phonetic units models and information stored in the TTS storage 220 for converting the input text into speech. The FE 216 and speech synthesis engine 218 may include their own controller(s)/processor(s) and memory or they may use the controller/processor 208 and memory 210 of the TTS device 202, for example. Similarly, the instructions for operating the FE 216 and speech synthesis engine 218 may be located within the TTS module 214, within the memory 210 and/or storage 212 of the TTS device 202, or within an external device.

Text input into a TTS module 214 may be sent to the FE 216 for processing. The front-end may include modules for performing text normalization, linguistic analysis, and linguistic prosody generation. During text normalization, the FE processes the text input and generates standard text, converting such things as numbers, abbreviations (such as Apt., St., etc.), symbols ($, %, etc.) into the equivalent of written out words.

During linguistic analysis the FE 216 analyzes the language in the normalized text to generate a sequence of phonetic units corresponding to the input text. This process may be referred to as phonetic transcription. Phonetic units include symbolic representations of sound units to be eventually combined and output by the TTS device 202 as speech. Various sound units may be used for dividing text for purposes of speech synthesis. A TTS module 214 may process speech based on phonemes (individual sounds), half-phonemes, di-phones (the last half of one phoneme coupled with the first half of the adjacent phoneme), bi-phones (two consecutive phonemes), syllables, words, phrases, sentences, or other units. Each word may be mapped to one or more phonetic units. Such mapping may be performed using a language dictionary stored in the TTS device 202, for example in the TTS storage module 220. The linguistic analysis performed by the FE 216 may also identify different grammatical components such as prefixes, suffixes, phrases, punctuation, syntactic boundaries, or the like. Such grammatical components may be used by the TTS module 214 to craft a natural sounding audio waveform output. The language dictionary may also include letter-to-sound rules and other tools that may be used to pronounce previously unidentified words or letter combinations that may be encountered by the TTS module 214. Generally, the more information included in the language dictionary, the higher quality the speech output.

Based on the linguistic analysis the FE 216 may then perform linguistic prosody generation where the phonetic units are annotated with desired prosodic characteristics, also called acoustic features, which indicate how the desired phonetic units are to be pronounced in the eventual output speech. During this stage the FE 216 may consider and incorporate any prosodic annotations that accompanied the text input to the TTS module 214. Such acoustic features may include pitch, energy, duration, and the like. Application of acoustic features may be based on prosodic models available to the TTS module 214. Such prosodic models indicate how specific phonetic units are to be pronounced in certain circumstances. A prosodic model may consider, for example, a phoneme's position in a syllable, a syllable's position in a word, a word's position in a sentence or phrase, neighboring phonetic units, etc. As with the language dictionary, prosodic model with more information may result in higher quality speech output than prosodic models with less information.

The output of the FE 216, referred to as a symbolic linguistic representation, may include a sequence of phonetic units annotated with prosodic characteristics. This symbolic linguistic representation may be sent to a speech synthesis engine 218, also known as a synthesizer, for conversion into an audio waveform of speech for output to an audio output device 204 and eventually to a user. The speech synthesis engine 218 may be configured to convert the input text into high-quality natural-sounding speech in an efficient manner. Such high-quality speech may be configured to sound as much like a human speaker as possible, or may be configured to be understandable to a listener without attempts to mimic a precise human voice.

A speech synthesis engine 218 may perform speech synthesis using one or more different methods. In one method of synthesis called unit selection, described further below, a unit selection engine 230 matches the symbolic linguistic representation created by the FE 216 against a database of recorded speech, such as a database of a voice corpus. The unit selection engine 230 matches the symbolic linguistic representation against spoken audio units in the database. Matching units are selected and concatenated together to form a speech output. Each unit includes an audio waveform corresponding with a phonetic unit, such as a short .wav file of the specific sound, along with a description of the various acoustic features associated with the .wav file (such as its pitch, energy, etc.), as well as other information, such as where the phonetic unit appears in a word, sentence, or phrase, the neighboring phonetic units, etc. Using all the information in the unit database, a unit selection engine 230 may match units to the input text to create a natural sounding waveform. The unit database may include multiple examples of phonetic units to provide the TTS device 202 with many different options for concatenating units into speech. One benefit of unit selection is that, depending on the size of the database, a natural sounding speech output may be generated. As described above, the larger the unit database of the voice corpus, the more likely the TTS device 202 will be able to construct natural sounding speech.

In another method of synthesis called parametric synthesis parameters such as frequency, volume, noise, are varied by a parametric synthesis engine 232, digital signal processor or other audio generation device to create an artificial speech waveform output. Parametric synthesis may use an acoustic model and various statistical techniques to match a symbolic linguistic representation with desired output speech parameters. Parametric synthesis may include the ability to be accurate at high processing speeds, as well as the ability to process speech without large databases associated with unit selection, but also typically produces an output speech quality that may not match that of unit selection. Unit selection and parametric techniques may be performed individually or combined together and/or combined with other synthesis techniques to produce speech audio output.

Parametric speech synthesis may be performed as follows. A TTS module 214 may include an acoustic model, or other models, which may convert a symbolic linguistic representation into a synthetic acoustic waveform of the text input based on audio signal manipulation. The acoustic model includes rules which may be used by the parametric synthesis engine 232 to assign specific audio waveform parameters to input phonetic units and/or prosodic annotations. The rules may be used to calculate a score representing a likelihood that a particular audio output parameter(s) (such as frequency, volume, etc.) corresponds to the portion of the input symbolic linguistic representation from the FE 216.

The parametric synthesis engine 232 may use a number of techniques to match speech to be synthesized with input phonetic units and/or prosodic annotations. One common technique is using Hidden Markov Models (HMMs). HMMs may be used to determine probabilities that audio output should match textual input. HMMs may be used to translate from parameters from the linguistic and acoustic space to the parameters to be used by a vocoder (a digital voice encoder) to artificially synthesize the desired speech. Using HMMs, a number of states are presented, in which the states together represent one or more potential acoustic parameters to be output to the vocoder and each state is associated with a model, such as a Gaussian mixture model. Transitions between states may also have an associated probability, representing a likelihood that a current state may be reached from a previous state. Sounds to be output may be represented as paths between states of the HMM and multiple paths may represent multiple possible audio matches for the same input text. Each portion of text may be represented by multiple potential states corresponding to different known pronunciations of phonemes and their parts (such as the phoneme identity, stress, accent, position, etc.). An initial determination of a probability of a potential phoneme may be associated with one state. As new text is processed by the speech synthesis engine 218, the state may change or stay the same, based on the processing of the new text. For example, the pronunciation of a previously processed word might change based on later processed words. A Viterbi algorithm may be used to find the most likely sequence of states based on the processed text. The HMMs may generate speech in parametrized form including parameters such as fundamental frequency (f0), noise envelope, spectral envelope, etc. that are translated by a vocoder into audio segments. The output parameters may be configured for particular vocoders such as a STRAIGHT vocoder, TANDEM-STRAIGHT vocoder, HNM (harmonic plus noise) based vocoders, CELP (code-excited linear prediction) vocoders, GlottHMM vocoders, HSM (harmonic/stochastic model) vocoders, or others.

Figure 3:
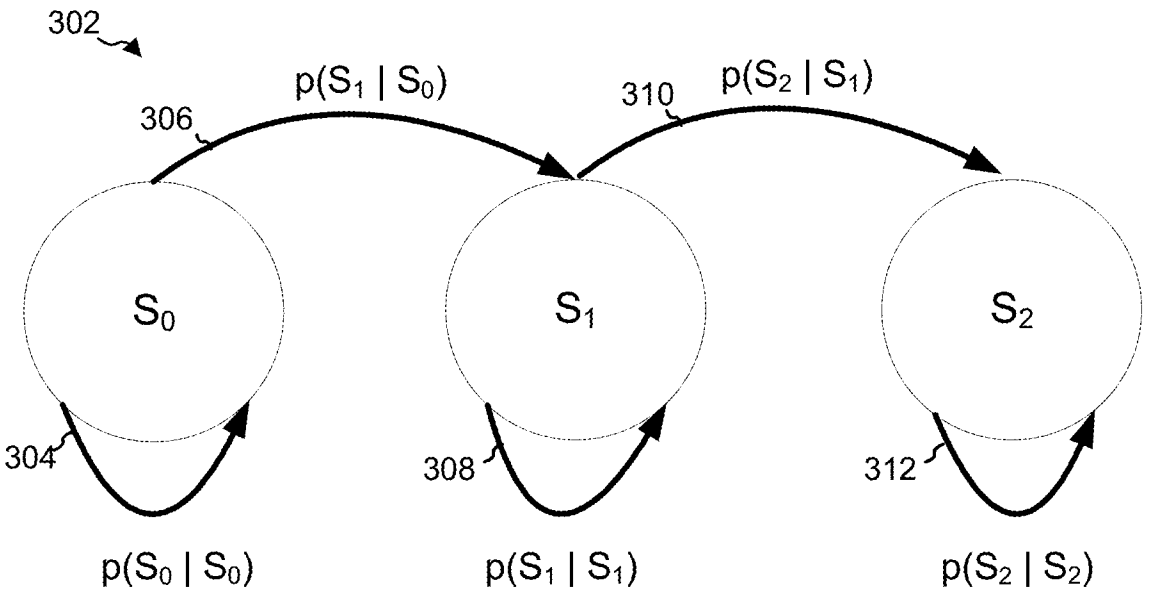
FIG. 3 illustrates speech synthesis using a Hidden Markov Model according to one aspect of the present disclosure.

An example of HMM processing for speech synthesis is shown in FIG. 3. A sample input phonetic unit, for example, phoneme /E/, may be processed by a parametric synthesis engine 232. The parametric synthesis engine 232 may initially assign a probability that the proper audio output associated with that phoneme is represented by state $S_0$ in the Hidden Markov Model illustrated in FIG. 3. After further processing, the speech synthesis engine 218 determines whether the state should either remain the same, or change to a new state. For example, whether the state should remain the same 304 may depend on the corresponding transition probability (written as $P(S_0|S_0)$, meaning the probability of going from state $S_0$ to $S_0$) and how well the subsequent frame matches states $S_0$ and $S_1$. If state $S_1$ is the most probable, the calculations move to state $S_1$ and continue from there. For subsequent phonetic units, the speech synthesis engine 218 similarly determines whether the state should remain at $S_1$, using the transition probability represented by $P(S_1|S_1)$ 308, or move to the next state, using the transition probability $P(\mathbf{5}_2|S_1)$ 310. As the processing continues, the parametric synthesis engine 232 continues calculating such probabilities including the probability 312 of remaining in state $S_2$ or the probability of moving from a state of illustrated phoneme /E/ to a state of another phoneme. After processing the phonetic units and acoustic features for state $S_2$, the speech recognition may move to the next phonetic unit in the input text.

The probabilities and states may be calculated using a number of techniques. For example, probabilities for each state may be calculated using a Gaussian model, Gaussian mixture model, or other technique based on the feature vectors and the contents of the TTS storage 220. Techniques such as maximum likelihood estimation (MLE) may be used to estimate the probability of particular states.

In addition to calculating potential states for one audio waveform as a potential match to a phonetic unit, the parametric synthesis engine 232 may also calculate potential states for other potential audio outputs (such as various ways of pronouncing phoneme /E/) as potential acoustic matches for the phonetic unit. In this manner multiple states and state transition probabilities may be calculated.

The probable states and probable state transitions calculated by the parametric synthesis engine 232 may lead to a number of potential audio output sequences. Based on the acoustic model and other potential models, the potential audio output sequences may be scored according to a confidence level of the parametric synthesis engine 232. The highest scoring audio output sequence, including a stream of parameters to be synthesized, may be chosen and digital signal processing may be performed by a vocoder or similar component to create an audio output including synthesized speech waveforms corresponding to the parameters of the highest scoring audio output sequence and, if the proper sequence was selected, also corresponding to the input text.

Unit selection speech synthesis may be performed as follows. Unit selection includes a two-step process. First a unit selection engine 230 determines what speech units to use and then it combines them so that the particular combined units match the desired phonemes and acoustic features and create the desired speech output. Units may be selected based on a cost function which represents how well particular units fit the speech segments to be synthesized. The cost function may represent a combination of different costs representing different aspects of how well a particular speech unit may work for a particular speech segment. For example, a target cost indicates how well a given speech unit matches the features of a desired speech output (e.g., pitch, prosody, etc.). A join cost represents how well a speech unit matches a consecutive speech unit for purposes of concatenating the speech units together in the eventual synthesized speech. The overall cost function is a combination of target cost, join cost, and other costs that may be determined by the unit selection engine 230. As part of unit selection, the unit selection engine 230 chooses the speech unit with the lowest overall combined cost. For example, a speech unit with a very low target cost may not necessarily be selected if its join cost is high.

A TTS device 202 may be configured with one or more voice corpuses for unit selection. Each voice corpus may include a speech unit database. The speech unit database may be stored in TTS storage 220, in storage 212, or in another storage component. The speech unit database includes recorded speech utterances with the utterances' corresponding text aligned to the utterances. The speech unit database may include many hours of recorded speech (in the form of audio waveforms, feature vectors, or other formats), which may occupy a significant amount of storage in the TTS device 202. The unit samples in the speech unit database may be classified in a variety of ways including by phonetic unit (phoneme, diphone, word, etc.), linguistic prosodic label, acoustic feature sequence, speaker identity, etc. The sample utterances may be used to create mathematical models corresponding to desired audio output for particular speech units. When matching a symbolic linguistic representation the speech synthesis engine 218 may attempt to select a unit in the speech unit database that most closely matches the input text (including both phonetic units and prosodic annotations). Generally the larger the voice corpus/speech unit database the better the speech synthesis may be achieved by virtue of the greater number of unit samples that may be selected to form the precise desired speech output.

Figure 4A:
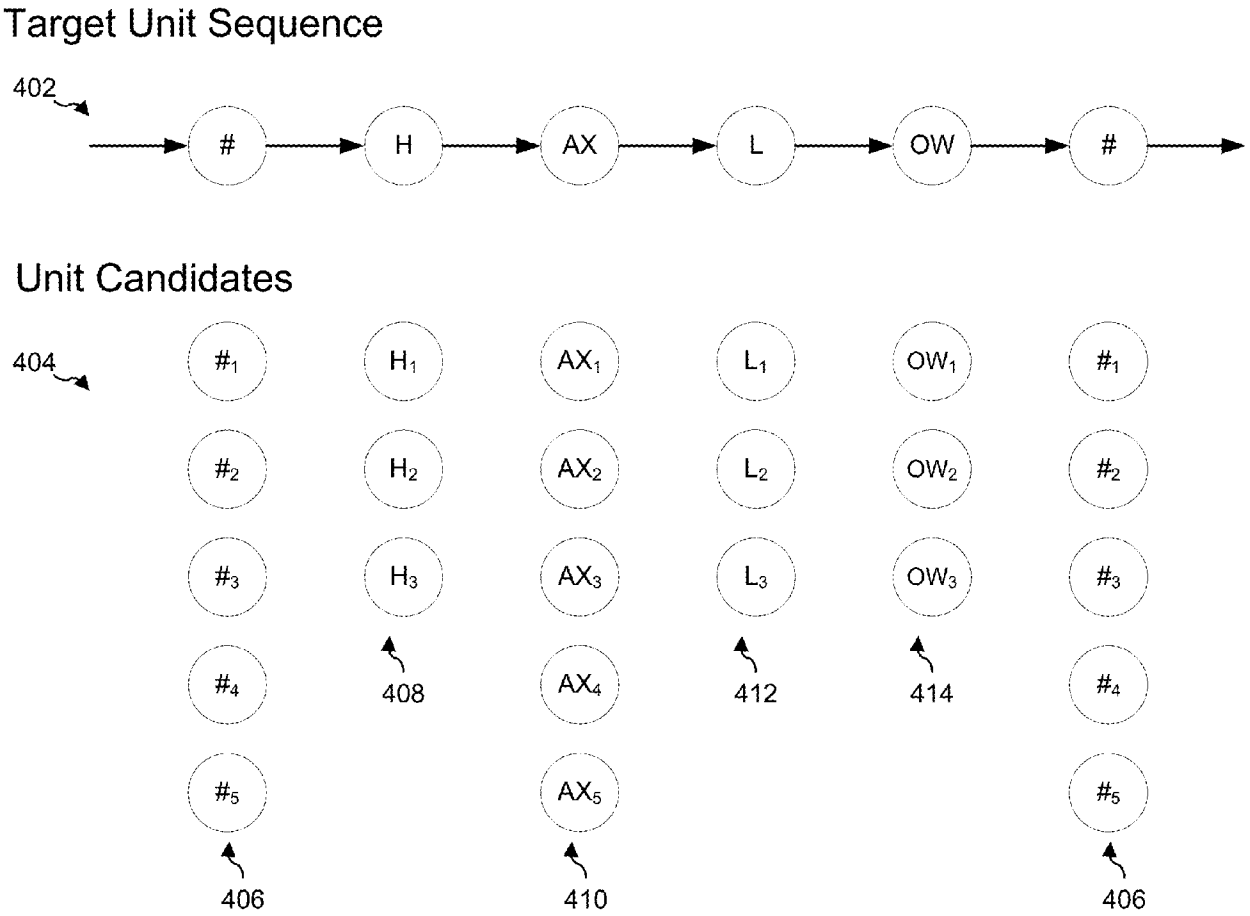
FIGS. 4A-4B illustrate speech synthesis using unit selection according to one aspect of the present disclosure.
Figure 4B:
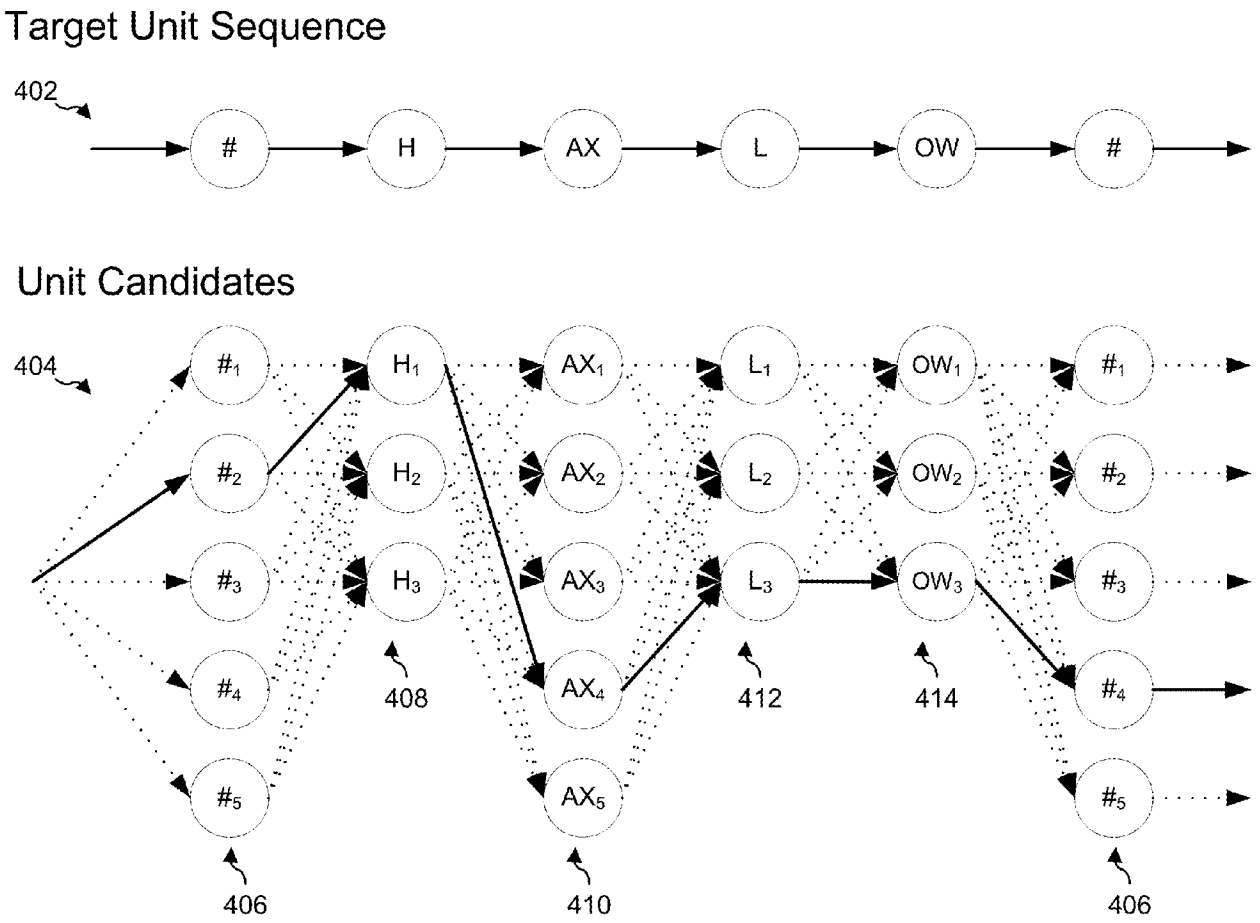

For example, as shown in FIG. 4A, a target sequence of phonetic units 402 to synthesize the word "hello" is determined by the unit selection engine 230. A number of candidate units 404 may be stored in the TTS storage 220. Although phonemes are illustrated in FIG. 4A, other phonetic units, such as diphones, may be selected and used for unit selection speech synthesis. For each phonetic unit there are a number of potential candidate units (represented by columns 406, 408, 410, 412 and 414) available in the voice corpus. The larger the voice corpus, the more potential candidate units are available. Each candidate unit represents a particular recording of the phonetic unit with a particular associated set of acoustic features. The unit selection engine 230 then creates a graph of potential sequences of candidate units to synthesize the available speech. The size of this graph may be variable based on certain device settings and/or the size of the voice corpus. Traversing the graph and selecting from among the candidate units becomes increasingly computationally expensive as the voice corpus/unit database increases in size. An example of this graph is shown in FIG. 4B. A number of potential paths through the graph are illustrated by the different dotted lines connecting the candidate units. A Viterbi algorithm may be used to determine potential paths through the graph. Each path may be given a score incorporating both how well the candidate units match the target units (with a high score representing a low target cost of the candidate units) and how well the candidate units concatenate together in an eventual synthesized sequence (with a high score representing a low join cost of those respective candidate units). The unit selection engine 230 may select the sequence that has the lowest overall cost (represented by a combination of target costs and join costs) or may choose a sequence based on customized functions for target cost, join cost or other factors. The candidate units along the selected path through the graph may then be combined together to form an output audio waveform representing the speech of the input text. For example, in FIG. 4B the selected path is represented by the solid line. Thus units $\#_2$, $H_1$, $AX_4$, $L_3$, $OW_3$, and $\#_4$ may be selected to synthesize audio for the word "hello."

Audio waveforms including the speech output from the TTS module 214 may be sent to an audio output device 204 for playback to a user or may be sent to the output device 207 for transmission to another device, such as another TTS device 202, for further processing or output to a user. Audio waveforms including the speech may be sent in a number of different formats such as a series of feature vectors, uncompressed audio data, or compressed audio data. For example, audio speech output may be encoded and/or compressed by an encoder/decoder (not shown) prior to transmission. The encoder/decoder may be customized for encoding and decoding speech data, such as digitized audio data, feature vectors, etc. The encoder/decoder may also encode non-TTS data of the TTS device 202, for example using a general encoding scheme such as .zip, etc. The functionality of the encoder/decoder may be located in a separate component or may be executed by the controller/processor 208, TTS module 214, or other component, for example.

Other information may also be stored in the TTS storage 220 for use in speech recognition. The contents of the TTS storage 220 may be prepared for general TTS use or may be customized to include sounds and words that are likely to be used in a particular application. For example, for TTS processing by a global positioning system (GPS) device, the TTS storage 220 may include customized speech specific to location and navigation. In certain instances the TTS storage 220 may be customized for an individual user based on his/her individualized desired speech output. For example a user may prefer a speech output voice to be a specific gender, have a specific accent, speak at a specific speed, have a distinct emotive quality (e.g., a happy voice), or other customizable characteristic. The speech synthesis engine 218 may include specialized databases or models to account for such user preferences. A TTS device 202 may also be configured to perform TTS processing in multiple languages. For each language, the TTS module 214 may include specially configured data, instructions and/or components to synthesize speech in the desired language(s). To improve performance, the TTS module 214 may revise/update the contents of the TTS storage 220 based on feedback of the results of TTS processing, thus enabling the TTS module 214 to improve speech recognition beyond the capabilities provided in the training corpus.

Figure 5:
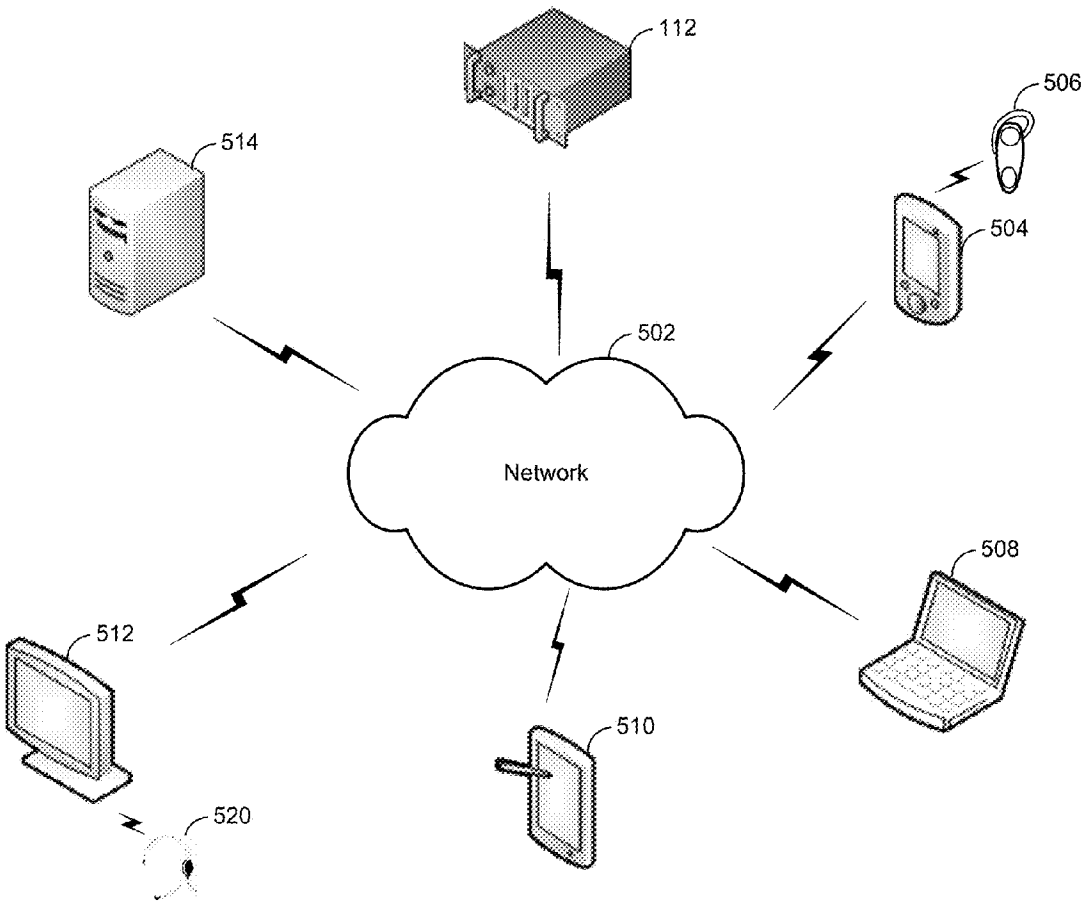
FIG. 5 illustrates a computer network for use with text-to-speech processing according to one aspect of the present disclosure.

Multiple TTS devices 202 may be connected over a network. As shown in FIG. 5 multiple devices may be connected over network 502. Network 502 may include a local or private network or may include a wide network such as the internet. Devices may be connected to the network 502 through either wired or wireless connections. For example, a wireless device 504 may be connected to the network 502 through a wireless service provider. Other devices, such as computer 512, may connect to the network 502 through a wired connection. Other devices, such as laptop 508 or tablet computer 510 may be capable of connection to the network 502 using various connection methods including through a wireless service provider, over a WiFi connection, or the like. Networked devices may output synthesized speech through a number of audio output devices including through headsets 506 or 520. Audio output devices may be connected to networked devices either through a wired or wireless connection. Networked devices may also include embedded audio output devices, such as an internal speaker in laptop 508, wireless device 504 or table computer 510.

In certain TTS system configurations, a combination of devices may be used. For example, one device may receive text, another device may process text into speech, and still another device may output the speech to a user. For example, text may be received by a wireless device 504 and sent to a computer 514 or server 516 for TTS processing. The resulting speech audio data may be returned to the wireless device 504 for output through headset 506. Or computer 512 may partially process the text before sending it over the network 502. Because TTS processing may involve significant computational resources, in terms of both storage and processing power, such split configurations may be employed where the device receiving the text/outputting the processed speech may have lower processing capabilities than a remote device and higher quality TTS results are desired. The TTS processing may thus occur remotely with the synthesized speech results sent to another device for playback near a user.

In one aspect, a remote TTS device may be configured with a prepared results module 222 as shown in FIG. 2. The prepared results module 222 may coordinate performing the steps illustrated in FIG. 1. For example, as new TTS requests come in, the prepared results module 222 may coordinate the storage (126) of the text of those TTS requests into TTS storage 220, or into other storage (for example storage 212). The prepared results module 222 may also coordinate processing of the stored text by the speech synthesis engine 218, for example, during a time when the TTS device 202 has time to process lower priority tasks. The prepared results module 222 may coordinate the storing of the output from the TTS processing of the stored tasks. The output may also be stored in TTS storage 220, or stored elsewhere. When processing the stored text in such a low priority manner (as in processing text not for responding to a specific TTS request), the prepared results module 222 may configure the TTS device 202 to turn off or disable particular system optimizations that are designed to increase processing speed but may reduce results quality (for example pre-selection, trimming, etc.).

Figure 6:
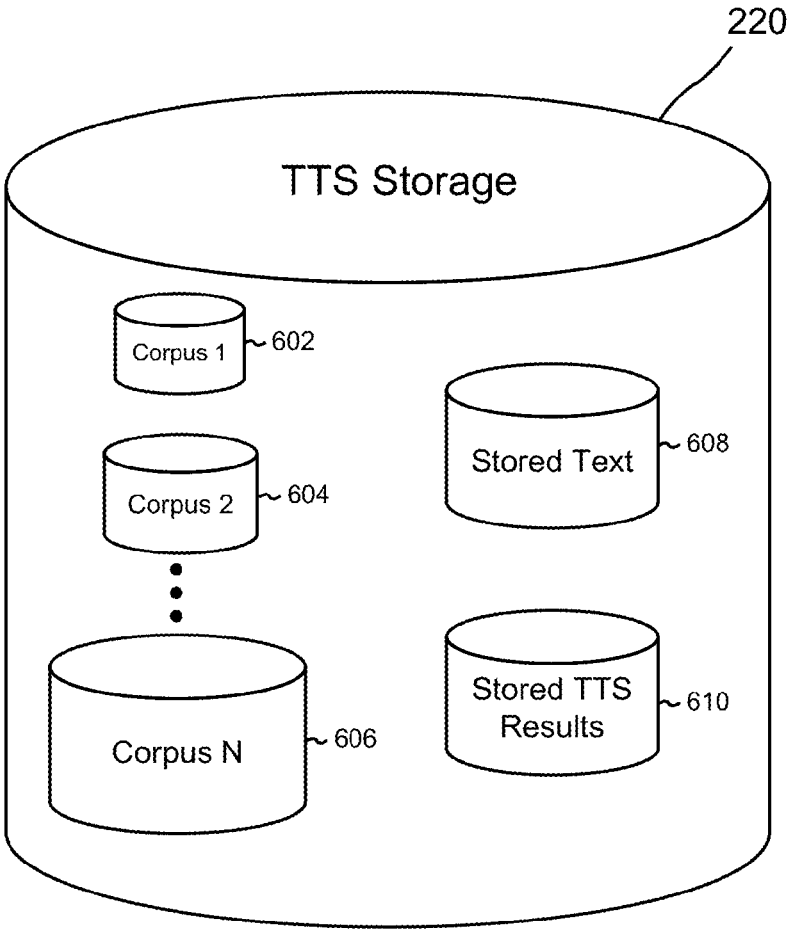
FIG. 6 illustrates TTS storage according to one aspect of the present disclosure.

As shown in FIG. 6, the TTS storage 220 may include a number of different voice corpuses. Shown are corpus 1 602, corpus 2 604, and corpus N 606. For purposes of illustration, the corpuses are shown in FIG. 6 in different sizes to illustrate that the corpuses themselves may be of varying sizes, though the sizes of the corpuses shown in FIG. 6 are not meant to be to scale. As also illustrated in FIG. 6, text 608 from previous TTS requests may be stored in TTS storage 220. The TTS storage 220 may also store previous TTS results 610.

The prepared results module 222 may compare the text of incoming TTS requests to the stored text 608. If matching text is found, the prepared results module 222 may identify the stored TTS output corresponds to the matching text. The stored TTS results 610 may be linked to the stored text 608 so the prepared results module 222 may identify what stored TTS output corresponds to what stored (and eventually matching) text.

The stored text 608 and stored TTS results 610 may be stored in a portion of the TTS storage 220 that is quickly accessible during the operation of TTS device 202, for example in a cache or other quickly accessible memory. Thus the TTS system may quickly match text and return TTS output in a manner that reduces user-noticeable delay.

In one aspect, the stored TTS results 610 may include different versions of TTS output corresponding to the same text. For example, text may be processed by different corpuses at different quality levels. In another example, different TTS outputs of similar quality, but resulting in different spoken output, may correspond to the same text. In this manner the TTS system may be configured to deliver different versions of high quality TTS results. For example, if a TTS system is often requested to process the text "the weather today will be", the TTS system may store several different ways of speaking that phrase (for example, by stressing different words in the phrase), so that the TTS system may be able to vary its output for that phrase. (To respond to specific requests, different versions of the TTS output corresponding to the phrase may be selected randomly or in some other manner to vary the output.)

In one aspect, if a first TTS request (such as that received in step 122) is particularly time sensitive, the TTS system may process the first TTS request using parametric synthesis described above. The TTS system may then later process the text of the first TTS request using a large voice corpus (128) and store the results in storage 610. The second (or later) TTS requests may then have the benefit of the high quality speech results even if the first TTS request was output using parametric synthesis.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. For example, the TTS techniques described herein may be applied to many different languages, based on the language information stored in the TTS storage.

Aspects of the present disclosure may be implemented as a computer implemented method, a system, or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid state memory, flash drive, removable disk, and/or other media.

Aspects of the present disclosure may be performed in different forms of software, firmware, and/or hardware. Further, the teachings of the disclosure may be performed by an application specific integrated circuit (ASIC), field programmable gate array (FPGA), or other component, for example.

Aspects of the present disclosure may be performed on a single device or may be performed on multiple devices. For example, program modules including one or more components described herein may be located in different devices and may each perform one or more aspects of the present disclosure. As used in this disclosure, the term "a" or "one" may include one or more items unless specifically stated otherwise. Further, the phrase "based on" is intended to mean "based at least in part on" unless specifically stated otherwise.

What is claimed is:

1. A method of performing text-to-speech (TTS) processing, the method performed by at least one processing device comprising a processor and a memory, the method comprising:

receiving a first TTS request comprising a representation of first text;

processing the representation of first text using a first voice corpus to produce a first TTS output, the first TTS output comprising speech corresponding to the representation of first text;

sending the first TTS output to a first device;

storing the representation of first text;

processing the representation of first text using a second voice corpus to produce a second TTS output, the second voice corpus being larger than the first voice corpus;

storing the second TTS output;

receiving a second TTS request comprising a representation of second text;

comparing the representation of second text to the stored representation of first text; and sending, to a second device, a third TTS output corresponding to the representation of second text, the third TTS output based at least in part on the stored second TTS output.

2. The method of claim 1, wherein the second TTS output comprises index references to units stored in a unit database associated with the second voice corpus, and wherein the method further comprises:

synthesizing speech using at least a portion of the index references; and sending the synthesized speech to the second device as part of the results.

3. A non-transitory computer-readable storage medium storing processor-executable instructions for controlling a computing device, comprising program code to:

receive a first text-to-speech (TTS) request including a representation of first text;

process the representation of first text using a first voice corpus to produce a first TTS output;

send the first TTS output to a first device;

store the representation of the first text;

process the representation of first text using a second voice corpus to produce a second TTS output, the second voice corpus being different from the first voice corpus;

store the second TTS output;

receive a second TTS request including a representation of second text;

compare the representation of second text to the representation of first text; and determine a third TTS output using at least a portion of the second TTS output, the third TTS output corresponding to the representation of second text.

4. The non-transitory computer-readable storage medium of claim 3, wherein the processing of the representation of first text using the first voice corpus occurs at a first time and the processing of the representation of first text using the second voice corpus occurs at a second time, the second time being after the first time.

5. The non-transitory computer-readable storage medium of claim 3, wherein the first voice corpus is smaller than the second voice corpus.

6. The non-transitory computer-readable storage medium of claim 3, further comprising program code to send the third TTS output to a second device, the second device being different from the first device.

7. The non-transitory computer-readable storage medium of claim 3, wherein the first TTS request is received from a different entity than the second TTS request.

8. The non-transitory computer-readable storage medium of claim 3, wherein the second TTS output comprises audio including synthesized speech.

9. The non-transitory computer-readable storage medium of claim 3, wherein the second TTS output comprises references to units stored in a unit database associated with the second voice corpus.

10. The non-transitory computer-readable storage medium of claim 9, wherein:

determining the third TTS output comprises synthesizing speech using at least a portion of the references; and the third TTS output comprises the synthesized speech.

11. The non-transitory computer-readable storage medium of claim 3, further comprising program code to disable a speed improvement technique of a TTS device prior to determining the second TTS output.

12. A computing device, comprising:

at least one processor;

a memory device including instructions operable to be executed by the at least one processor to perform a set of actions, configuring the at least one processor to:

receive a first text-to-speech (TTS) request including a representation of first text;

process the representation of first text using a first voice corpus to produce a first TTS output;

send the first TTS output to a first device;

store the representation of the first text;

process the representation of first text using a second voice corpus to produce a second TTS output, the second voice corpus being different from the first voice corpus;

store the second TTS output;

receive a second TTS request including a representation of second text;

compare the representation of second text to the representation of first text; and determine a third TTS output using at least a portion of the second TTS output, the third TTS output corresponding to the representation of second text.

13. The computing device of claim 12, wherein the processing of the representation of first text using the first voice corpus occurs at a first time and the processing of the representation of first text using the second voice corpus occurs at a second time, the second time being after the first time.

14. The computing device of claim 12, wherein the first voice corpus is smaller than the second voice corpus.

15. The computing device of claim 12, wherein the at least one processor is further configured to send the third TTS output to a second device, the second device being different from the first device.

16. The computing device of claim 12, wherein the first TTS request is received from a different entity than the second TTS request.

17. The computing device of claim 12, wherein the second TTS output comprises audio including synthesized speech.

18. The computing device of claim 12, wherein the second TTS output comprises references to units stored in a unit database associated with the second voice corpus.

19. The computing device of claim 18, wherein:

determining the third TTS output comprises synthesizing speech using at least a portion of the references; and the third TTS output comprises the synthesized speech.

20. The computing device of claim 12, wherein the at least one processor is further configured to disable a speed improvement technique of a TTS device prior to determining the second TTS output.

* * * * *